US007089772B1

(12) United States Patent
Nyssen et al.

(10) Patent No.: US 7,089,772 B1
(45) Date of Patent: Aug. 15, 2006

(54) ADJUSTABLE HORN FOR SPIRAL PIPE FORMING MACHINE

(75) Inventors: James Nyssen, Chilliwack (CA); Bradley Norman Miller, Langley (CA)

(73) Assignee: IMW Industries Limited, Chilliwack (CA)

( * ) Notice: Subject to any disclaimer, the term of this patent is extended or adjusted under 35 U.S.C. 154(b) by 0 days.

(21) Appl. No.: 11/101,332

(22) Filed: Apr. 7, 2005

(51) Int. Cl.
*B21C 37/12* (2006.01)

(52) U.S. Cl. ..... 72/49

(58) Field of Classification Search ..... 72/48, 72/49, 50

See application file for complete search history.

(56) References Cited

U.S. PATENT DOCUMENTS 2,862,469 A * 12/1958 Jensen ..... 72/49
4,070,886 A * 1/1978 Nyssen ..... 72/49
4,436,239 A * 3/1984 Tsuyama et al. ..... 228/17
4,578,971 A * 4/1986 Leweke et al. ..... 72/10.1

* cited by examiner

*Primary Examiner*—Lowell A. Larson
(74) *Attorney, Agent, or Firm*—Barnes & Thornburg LLP

(57) ABSTRACT

An adjustable horn or mandrel for a spiral pipe forming machine. Such machines are made for continuously forming metal pipe from an elongated sheet of metal where the sheet is curled into adjacent helical convolutions in a multiple roll pipe forming head. The head includes a mandrel, and in accordance with the invention a mandrel mount is provided for vertical adjustment of the mandrel. The mandrel mount has opposite side supports sandwiching the mandrel and a motor mounted for raising and lowering the mandrel between the side supports. Raising and lowering is accomplished via a pair lead screws secured to the mandrel, each having a gear threadedly engaged thereon and which is driven by the motor. The mandrel is also horizontally adjustable.

16 Claims, 5 Drawing Sheets

ADJUSTABLE HORN FOR SPIRAL PIPE FORMING MACHINE

BACKGROUND OF THE INVENTION

This invention relates to metal pipe forming apparatus, and in particular to a mount for the horn or mandrel in the multiple roll pipe forming head of the apparatus.

Machines for continuously manufacturing metal pipe from an elongated sheet of metal are well known. Such pipe is used for a variety of purposes, including culvert. U.S. Pat. No. 3,247,692 is directed to a spiral pipe making machine having a pipe forming head comprising three adjustable rolls, each of the rolls comprising a series of interconnected rollers.

U.S. Pat. No. 4,070,886, developed by one of the inventors of the present application, is directed to a more sophisticated but similar pipe forming machine for forming pipe from helical convolutions, where the rollers of the pipe forming device are automatically adjusted when different diameters of pipe are to be manufactured. The '886 patent include a horn or mandrel in the forming device about which the helical convolutions of metal are curled in an upward orientation. It is a horn or mandrel, such as that of the '886 patent, which is the subject matter of the present application, and U.S. Pat. No. 4,070,886 is hereby incorporated herein by reference.

SUMMARY OF THE INVENTION

The invention is directed to an apparatus for continuously forming metal pipe from an elongated sheet of metal, with the apparatus having a shaping device to drive the sheet and to impress desired longitudinal impressions in the sheet, a multiple roll pipe forming device for accepting the sheet and curling the sheet into adjacent, helical convolutions, with the multiple roll pipe forming device having a mandrel mounting one set of pipe forming rollers. A seaming device is included to join adjacent helical convolutions, and a cut-off device is provided for severing successive lengths of metal pipe emerging from the multiple roll pipe forming device. In accordance with the invention, a mandrel mount is provided for vertical adjustment of the mandrel. The mandrel mount has opposite sides support sandwiching the mandrel and a motor mounted for raising and lowering the mandrel between the side supports.

In accordance with the preferred form of the invention, the motor is mounted on a top plate secured to the side supports. A lead screw is provided, secured to the mandrel and extending through the top plate, with a gear threadedly engaged on the lead screw. The motor drivingly engages the gear for raising and lowering the lead screw. The lead screw is attached to a foot secured to a slide fixed to the top of the mandrel, and preferably a pair of lead screws is provided, each having a respective gear drivingly engaged by the motor.

The mandrel is also provided with a horizontal adjustment. The horizontal adjustment comprises an end plate secured to the side supports and a lateral adjustment screw threadedly engaged in the end plate and rotatably secured to the mandrel. The adjustment screw includes a slide engaged in a slide channel attached to the mandrel.

BRIEF DESCRIPTION OF THE DRAWINGS

The invention is described in greater detail in the following description of an example embodying the best mode of the invention, taken in conjunction with the drawing figures, in which.

DESCRIPTION OF AN EXAMPLE EMBODYING THE BEST MODE OF THE INVENTION

Figure 1:
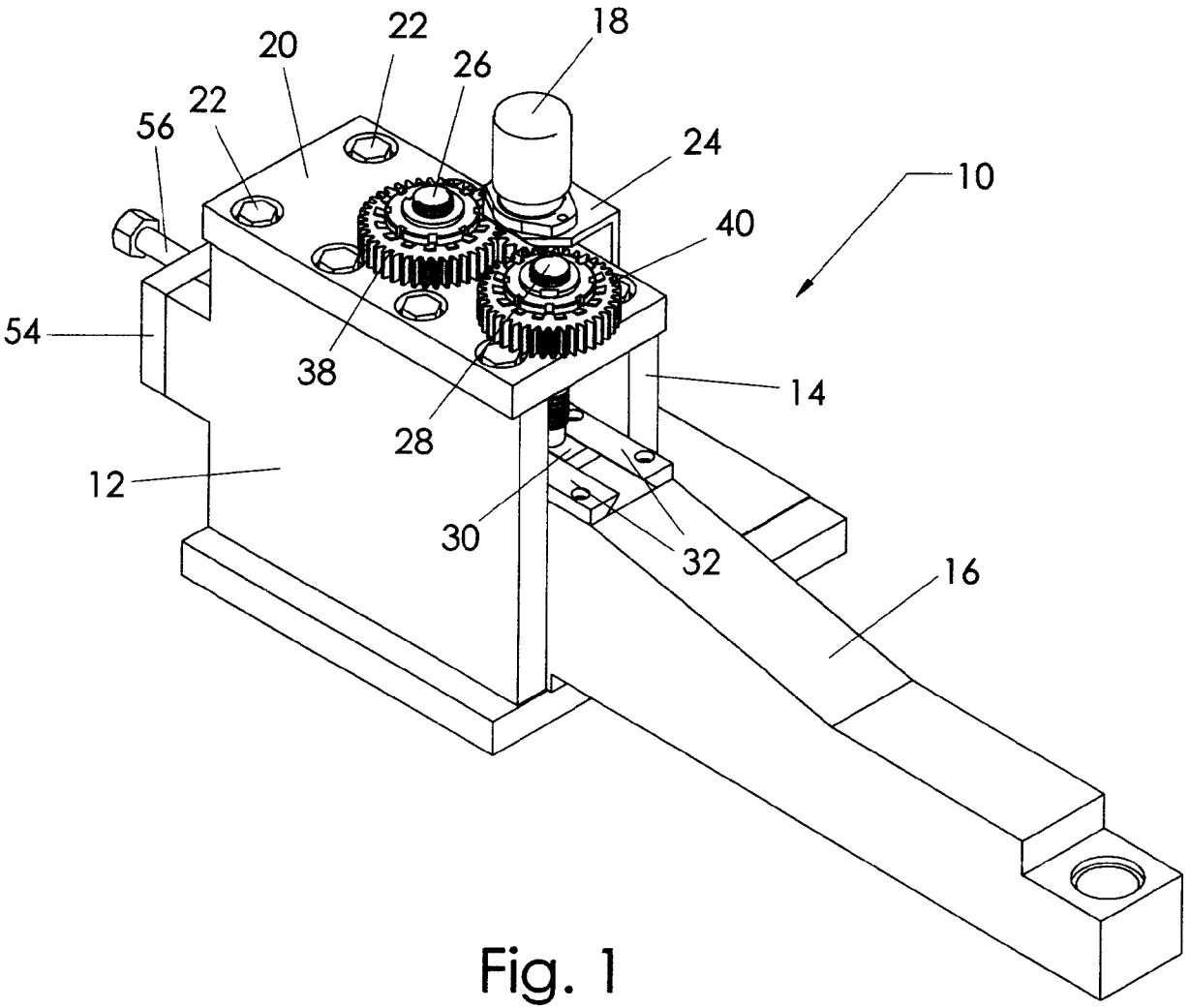
FIG. 1 is a front perspective view of an adjustable mandrel mount according to the invention.
Figure 2:
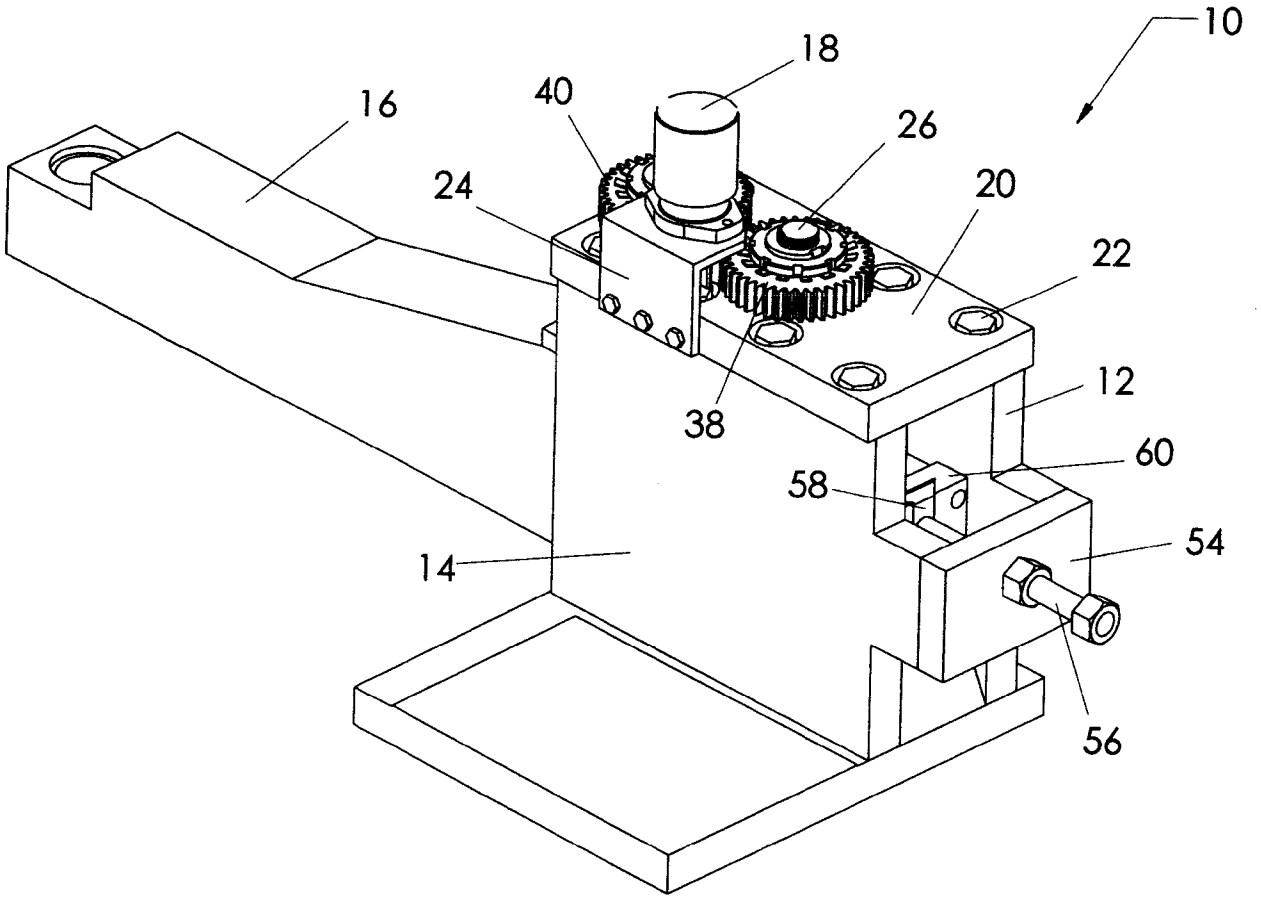
FIG. 2 is a rear perspective view of the adjustable mandrel mount of FIG. 1.
Figure 3:
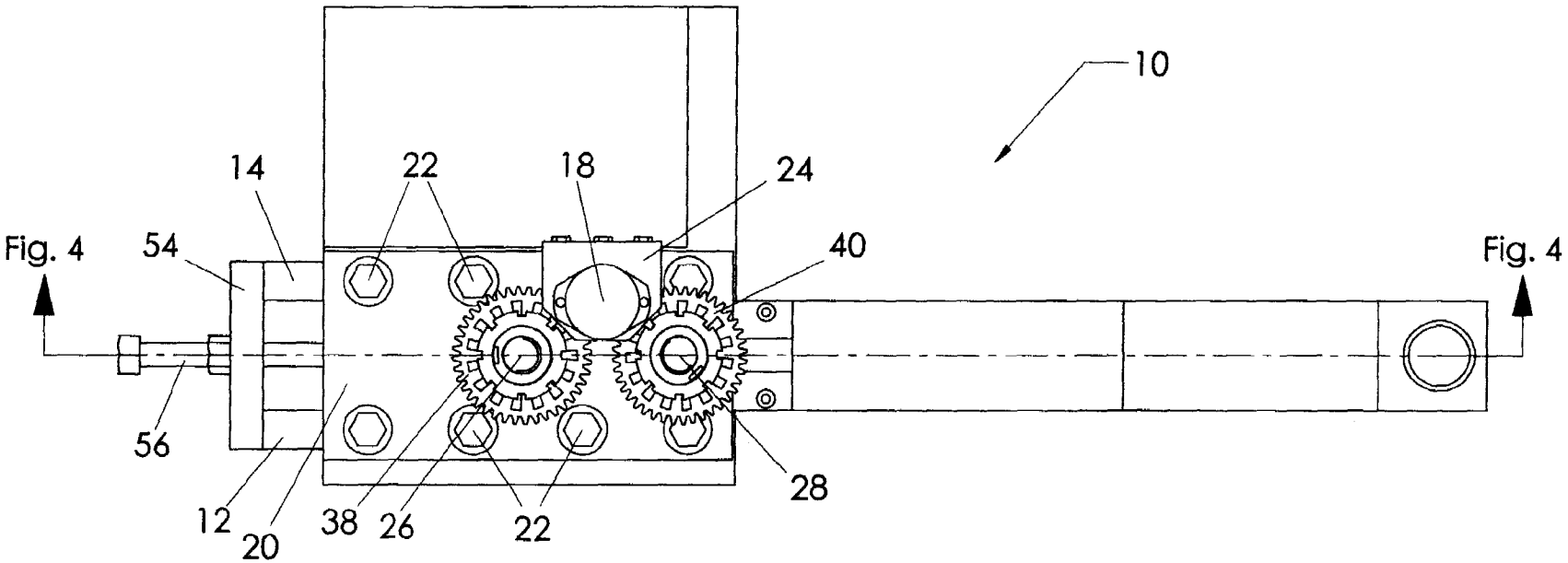
FIG. 3 is a top plan view of the adjustable mandrel mount of FIG. 1.
Figure 4:
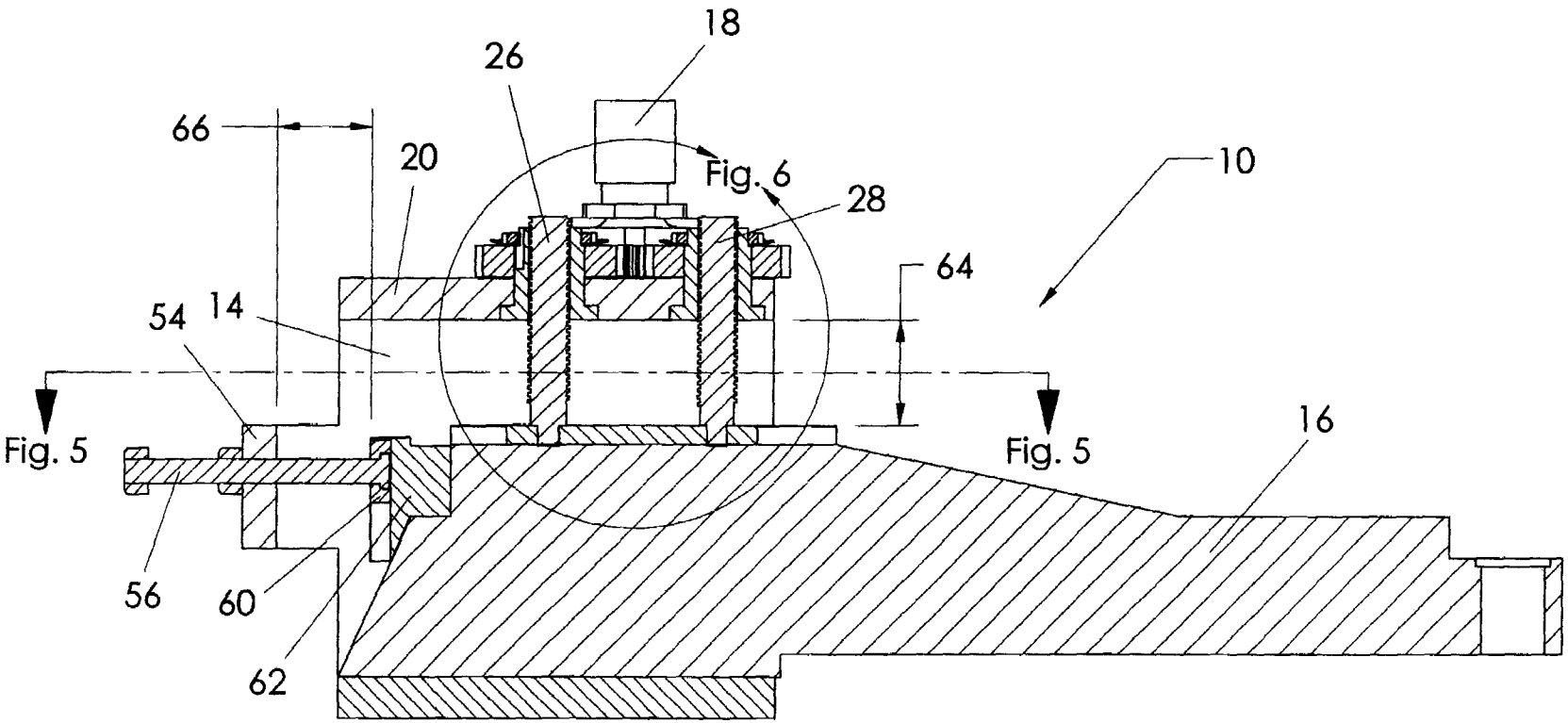
FIG. 4 is a cross sectional view taken along lines 4—4 of FIG. 3.
Figure 5:
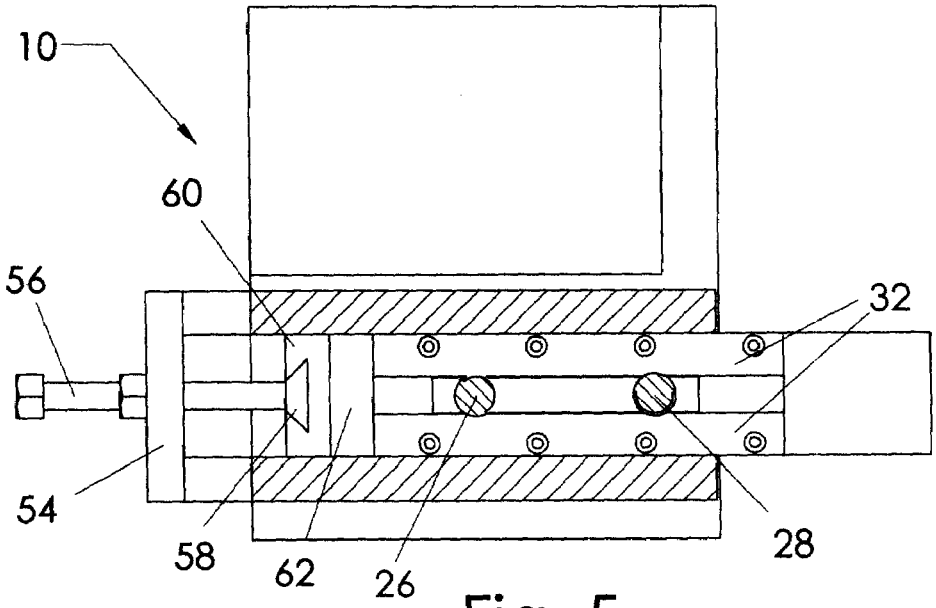
FIG. 5 is a cross sectional view taken along lines 5—5 of FIG. 4.
Figure 6:
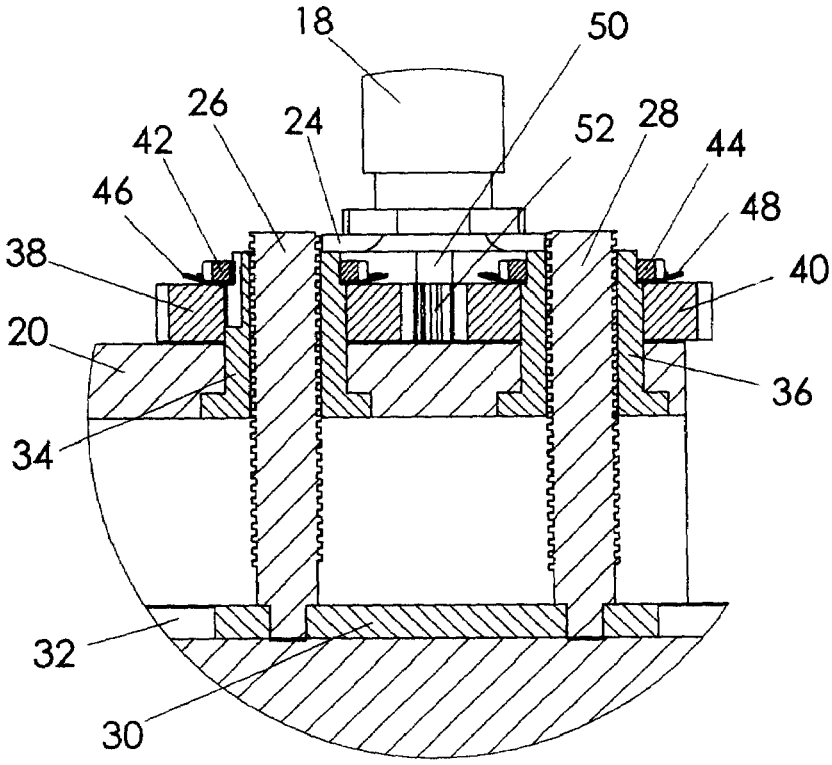
FIG. 6 is an enlarged sectional view taken along lines 6—6 of FIG. 4.

An adjustable mandrel mount according to the invention is show generally at 10 in the drawing figures. The adjustable mandrel mount 10 can be used in any multiple roll pipe forming device such as that of incorporated U.S. Pat. No. 4,070,886, and in relation to the '886 patent, is used in place of the horn member 120.

The mandrel mount 10 includes opposite side supports 12 and 14 sandwiching a horn or mandrel 16 therebetween. The element 16 will be identified as a mandrel henceforth. The side supports 12 and 14 are appropriately rigidly fixed in place with the mandrel 16 movable therebetween as explained below.

The mandrel 16 is movable both horizontally and vertically. For raising and lowering the mandrel 16, a motor 18 is mounted above a top plate 20, the top plate 20 being secured to the side supports 12 and 14 by appropriate means, such as bolts 22. The motor 18 can be mounted in place in any appropriate manner, and as illustrated, is secured to an angled plate 24 bolted to one side of the top plate 20. Any appropriate type of motor can be used for the motor 18.

A pair of lead screws 26 and 28 is secured in a slide foot 30 attached to a slide 32 fixed to the top of the mandrel 16. Each of the lead screws 26 and 28 is externally threaded and extends in a respective bushing 34 and 36. Respective gears 38 and 40 are mounted on the bushings 34 and 36, held in place by respective nuts 42 and 44 bearing on respective lock washers 46 and 48.

The motor 18 has a downwardly depending shaft 50 with a spur gear 52 mounted thereon. As illustrated, the spur gear 52 engages the gears 38 and 40 for rotation thereof.

The mandrel 16 is also horizontally adjustable. An end plate 54 is secured to the side supports 12 and 14, with a lateral adjustment screw 56 threadedly engaged in the end plate 54 secured to the side supports 12 and 14 and rotatably secured to the mandrel 16. As illustrated, the adjustment screw 56 extends to a slide 58 engaged in a slide channel 60. The slide channel 60 extends from a slide base 62 secured to the mandrel 16. By appropriate adjustment of the adjustment screw 56, the lateral position of the mandrel 16 in relation to the side supports 12 and 14 is changed.

In operation, the motor 18 is used to adjust the vertical position of the mandrel 16. When the motor 18 is activated, the spur gear 52 rotates, rotating the gears 38 and 40, and thus raising or lowering the lead screws 26 and 28 in unison, depending on the direction of rotation of the spur gear 52 by the motor 18. The extent of travel of the mandrel 16 in the vertical direction is indicated at 64. The slide 58 in the slide channel 60 permits the raising and lowering of the mandrel 16 without interference of the horizontal adjustment screw 56. Horizontal adjustment, as indicated above, is by means of the adjustment screw 56, and the slide foot 30 in the slide 32 permits that movement without interference by the lead screws 26 and 28. The extent of travel of the mandrel 16 in the horizontal direction is indicated at 66.

The invention provides a means of adjusting the mandrel 16 vertically, while maintaining the rigidity and strength required of the mandrel 16. This accommodates wear of the rollers (not illustrated) secured beneath the mandrel 16 for curling of metal sheet into helical convolutions, and facilitates initial feeding of the elongated sheet of metal into the forming head and ready adjustment, as needed, during formation of metal pipe.

Various changes can be made to the invention without departing from the spirit thereof or scope of the following claims.

What is claimed is:

1. An apparatus for continuously forming metal pipe from an elongated sheet of metal, the apparatus having a shaping device to drive the sheet and to impress desired longitudinal impressions in the sheet, a multiple roll pipe forming device for accepting the sheet and curling the sheet into adjacent, helical convolutions, the multiple roll pipe forming device having a mandrel mounting one set of pipe forming rollers, a seaming device to join adjacent helical convolutions, and a cut-off device for severing successive lengths of metal pipe emerging from the multiple roll pipe forming device, the improvement comprising a mandrel mount for vertical adjustment of said mandrel, said mandrel mount having opposite side supports sandwiching said mandrel and a motor mounted for raising and lowering said mandrel between said side supports.

2. The apparatus according to claim 1, in which said motor is mounted on a top plate secured to said side supports.

3. The apparatus according to claim 2, including a lead screw secured to said mandrel and extending through said top plate, and a gear threadedly engaged on said lead screw, said motor drivingly engaging said gear for raising and lowering said lead screw.

4. The apparatus according to claim 3, in which said lead screw is attached to a foot secured to a slide fixed to said mandrel.

5. The apparatus according to claim 3, including a pair of said lead screws, each having a respective said gear drivingly engaged by said motor.

6. The apparatus according to claim 1, including a horizontal adjustment for said mandrel.

7. The apparatus according to claim 6, in which said horizontal adjustment comprises an end plate secured to said side supports and a lateral adjustment screw threadedly engaged in said end plate and rotatably secured to said mandrel.

8. The apparatus according to claim 7, in which said adjustment screw includes a slide engaged in a slide channel attached to said mandrel.

9. An adjustable mandrel system for a pipe forming head of a multiple roll metal pipe forming apparatus, comprising a. a pair of fixed side supports in said head, b. a mandrel located between said side supports, and c. a motor mounted for raising and lowering said mandrel between said side supports.

10. The adjustable mandrel system according to claim 9, in which said motor is mounted on a top plate secured to said side supports.

11. The adjustable mandrel system according to claim 10, including a lead screw secured to said mandrel and extending through said top plate, and a gear threadedly engaged on said lead screw, said motor drivingly engaging said gear for raising and lowering said lead screw.

12. The adjustable mandrel system according to claim 11, in which said lead screw is attached to a foot secured to a slide fixed to said mandrel.

13. The adjustable mandrel system according to claim 11, including a pair of said lead screws, each having a respective said gear drivingly engaged by said motor.

14. The adjustable mandrel system according to claim 9, including a horizontal adjustment for said mandrel.

15. The adjustable mandrel system according to claim 14, in which said horizontal adjustment comprises an end plate secured to said side supports and a lateral adjustment screw threadedly engaged in said end plate and rotatably secured to said mandrel.

16. The adjustable mandrel system according to claim 15, in which said adjustment screw includes a slide engaged in a slide channel attached to said mandrel.

* * * * *